US005994015A

United States Patent [19]

Vail

[11] Patent Number: 5,994,015

[45] Date of Patent: Nov. 30, 1999

[54] CARRIER MATERIALS

[75] Inventor: Wilfred E. Vail, Litchfield, N.H.

[73] Assignee: Nashua Corporation, Nashua, N.H.

[21] Appl. No.: 09/012,832

[22] Filed: Jan. 23, 1998

[51] Int. Cl.[6] ..... G03G 9/083

[52] U.S. Cl. ..... 430/106.6; 430/108; 430/111; 430/137

[58] Field of Search ..... 430/106.6, 108, 430/137, 111

[56] References Cited

U.S. PATENT DOCUMENTS

| | | | |
|---|---|---|---|
| Re. 32,883 | 3/1989 | Lu | 430/110 |
| 4,147,834 | 4/1979 | Munzel et al. | 428/407 |
| 4,286,038 | 8/1981 | Lu et al. | 430/108 |
| 4,298,672 | 11/1981 | Lu | 430/108 |
| 4,433,040 | 2/1984 | Niimura et al. | 430/109 |
| 4,440,617 | 4/1984 | Solomon | 204/290 |
| 4,518,705 | 5/1985 | Solomon et al. | 502/101 |
| 4,614,700 | 9/1986 | Yamamoto et al. | 430/122 |
| 4,868,082 | 9/1989 | Kohri et al. | 430/106.6 |
| 4,883,736 | 11/1989 | Hoffend et al. | 430/110 |
| 4,912,005 | 3/1990 | Goodman et al. | 430/108 |
| 4,929,528 | 5/1990 | Shionki et al. | 430/108 |
| 4,935,326 | 6/1990 | Creatura et al. | 430/108 |
| 4,937,166 | 6/1990 | Creatura et al. | 430/108 |
| 4,963,455 | 10/1990 | Laing et al. | 430/106.6 |
| 5,002,846 | 3/1991 | Creatura et al. | 430/108 |
| 5,015,550 | 5/1991 | Creatura et al. | 430/108 |
| 5,071,725 | 12/1991 | Kubo et al. | 430/108 |
| 5,071,726 | 12/1991 | Maniar | 430/106.6 |
| 5,100,753 | 3/1992 | Maniar et al. | 430/137 |
| 5,102,769 | 4/1992 | Creatura | 430/137 |
| 5,104,762 | 4/1992 | Shirose et al. | 430/106.6 |
| 5,126,225 | 6/1992 | Wilson et al. | 430/108 |
| 5,162,187 | 11/1992 | Lyons et al. | 430/106.6 |
| 5,180,650 | 1/1993 | Sacripante et al. | 430/106.6 |
| 5,192,635 | 3/1993 | Inukai et al. | 430/108 |
| 5,213,936 | 5/1993 | Creatura et al. | 430/124 |
| 5,230,980 | 7/1993 | Maniar | 430/137 |
| 5,330,874 | 7/1994 | Mahabadi et al. | 430/137 |
| 5,393,631 | 2/1995 | Horikoshi et al. | 430/108 |
| 5,411,832 | 5/1995 | Yoerger | 430/108 |
| 5,491,044 | 2/1996 | Wilson et al. | 430/110 |
| 5,496,675 | 3/1996 | Van Dusen et al. | 430/137 |
| 5,504,558 | 4/1996 | Ikezue | 335/211 |
| 5,504,559 | 4/1996 | Ojima et al. | 355/211 |
| 5,506,083 | 4/1996 | Nash et al. | 430/106 |
| 5,510,220 | 4/1996 | Nash et al. | 430/106 |
| 5,512,403 | 4/1996 | Tyagi et al. | 430/106.6 |
| 5,514,512 | 5/1996 | Cunningham et al. | 430/137 |
| 5,514,513 | 5/1996 | Cunningham et al. | 430/137 |
| 5,514,514 | 5/1996 | Cunningham et al. | 430/137 |
| 5,516,614 | 5/1996 | Nash et al. | 430/106.6 |
| 5,516,618 | 5/1996 | Cunningham et al. | 430/137 |
| 5,518,855 | 5/1996 | Creatura et al. | 430/137 |
| 5,534,379 | 7/1996 | Dalal et al. | 430/106 |
| 5,567,562 | 10/1996 | Creatura et al. | 430/108 |
| 5,576,818 | 11/1996 | Badesha et al. | 355/271 |
| 5,595,851 | 1/1997 | Creatura et al. | 430/108 |
| 5,607,804 | 3/1997 | Bertrand et al. | 430/106 |
| 5,620,820 | 4/1997 | Bertrand et al. | 430/42 |
| 5,627,001 | 5/1997 | Vail | 430/108 |
| 5,656,408 | 8/1997 | Silence | 430/106.6 |
| 5,700,615 | 12/1997 | Silence et al. | 430/106.6 |

FOREIGN PATENT DOCUMENTS

| | | | |
|---|---|---|---|
| 302686 | 2/1989 | European Pat. Off. | G03G 9/08 |

*Primary Examiner*—Mark Chapman
*Attorney, Agent, or Firm*—George W. Neuner

[57] ABSTRACT

Improved carrier materials for use in electrophotographic processes and processes for producing such carrier materials are disclosed. The carrier materials feature a preferably conductive core coated with an first conductive layer and a second, insulative layer. The coating layers preferably comprise a fluoropolymer matrix or other triboelectrically chargeable substance or substances. In one embodiment the same fluoropolymer is used in the first and second coatings.

35 Claims, 2 Drawing Sheets

CARRIER MATERIALS

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

The present invention relates to electrophotographic carrier particles, and particularly to carrier particles for electrophotographic developers which provide improved solid area development.

Electrophotographic processes and apparatus employ the use of toners, which typically comprise a resin and a colorant, along with other desirable additives like charge control agents. In general, a desired image is formed on an organic photoconductor (OPC) coated medium such as a drum or belt in the form of a charged pattern representing the image. Toner is electrically attracted to the charge on the drum and adheres to the drum in an imagewise manner. Lastly, the toner image is transferred from the OPC medium to an image-receiving substrate (typically paper) and fused, resulting in permanent image formation on the substrate.

In magnetic brush development systems, charge is imparted to the toner triboelectrically by mixing toner particles with carrier particles, typically resin-coated steel particles about 20 to 200 $\mu$m in diameter. The toner particles adhere to the oppositely-charged carrier particles and are conveyed from a hopper to the magnetic brush roller system. On the roller, chains of the toner-laden carrier particles form, and as the chains are conveyed on the roller into the gap between the roller and the OPC medium, the charged toner particles are attracted to and deposited on the oppositely-charged latent image areas of the OPC medium. The carrier particles are collected and recycled for remixing with toner.

Since the carrier is a recyclable component of the developer, it is desirable to make the carrier last as long as possible, to minimize cost of usage. After a period of mixing with toner, toner particles tend to irreversibly adhere to the carrier, rendering triboelectric charging ineffective and necessitating replacement of the carrier. This is a problem sometimes referred to as "toner scum", and is noted with fluoropolymer coating materials such as polytetrafluoroethylene (PTFE). However, these materials are triboelectrically desirable for use in making carrier; fluoropolymers typically have a low surface free energy due to the presence of carbon-to-fluorine bonds and, as such, make ideal materials for carrier coating. Toner filming or scum may be suppressed by incorporating certain silicones and copolymers of tetrafluoroethylene (TFE), p-vinylidene fluoride and the like. However, the lack of solubility in common organic solvents and lack of adhesion to ferromagnetic substrate materials effectively precludes their use with normal fluidic coating equipment and processes. The lack of adhesion problem has been addressed by the provision of another agent such as a heat-curable epoxy system to adhere the PTFE to the substrate, but this solution is less than desirable, since the presence of the epoxy alters the characteristics of the end-product carrier material.

Another problem in the art relates to solid area development and the control thereof. In carrier/toner systems, uniform application of toner, i.e., "toning," across relatively large area of the document is desired. This is commonly called "solid area fill." During formation of a latent image on the photoconductor surface, an electric field is formed of the size and shape of the optically projected image (i.e., "imagewise".) Electrostatic field lines of force tend to migrate to the edges of the latent image field, and toner, during development, follows these lines of force. If the shape of the field is not corrected, most toner will be deposited along the edges of the latent image field, resulting in little or no development of the interior of the image, a condition known as "hollow character defect" or "edging."

A generally applied solution to correct this defect is to move a conductive bar or the like into the field, whose force lines project into space. This has the effect of making the field lines project perpendicularly to the photoconductor surface and to space themselves evenly across the large solid image field. This effect is commonly known as the "development electrode effect;" the conductive material is termed the "development electrode."

Ferromagnetic carriers used in magnetic brush development take the place of solid development electrodes; if they are sufficiently conductive, the carrier renders excellent solid area fill to large image areas. The conductivity of the carrier particle determines the strength of the development electrode effect.

Examples of carrier core materials used in the prior art range from extremely resistive flint glass (which is only able to develop solid areas not larger than ordinary type fonts); to powdered iron and steel, which develops excellent solid area fill, but is highly susceptible to either rusting in high moisture environments, or the formation of "scale" which interferes with carrier coating adhesion. These core materials must be passivated and cleaned, either chemically or by surface oxidation.

Synthetic ferrite core materials are not rendered useless by moisture, since they are formed from metal oxides. They are more resistive than iron and more conductive than glass beads. To improve their solid area image development, however, it is usually necessary to incorporate electroconductive particles in the coating to enhance the development electrode effect.

Improved solid area fill arises from using greater amounts of electroconductive particles, but in prior art systems, large amounts (e.g., 10–12% by weight of coating) of carbon are used, resulting in the coating becoming so conductive as to preclude sufficient charging of toner, as evidenced by higher "background" and excessively dirty machines, as well as low yield (number of copies/cartridge.) Accordingly, improved development systems addressing these issues have been desired.

BRIEF SUMMARY OF THE INVENTION

Improved carrier materials and processes for producing them are presently disclosed. The carrier materials comprise a core coated with a first, conductive layer and a second, insulative layer. The second, insulative layer provides more precise control of the conductivity of the carrier particle. More specifically, the second, insulative layer allows for the use of carrier particles with high conductivity so as to provide superior solid image quality, while maintaining a proper resistance so the toner with which the carrier is mixed is properly charged. The coating layers preferably comprise a fluoropolymer or other triboelectrically chargeable matrix. Preferably the same fluoropolymer is used in the first and second layers, with the layers formulated to obtain desired conductivity and insulative properties.

In one embodiment of the invention, the first, conductive layer comprises a fluoropolymer matrix containing conductive particles such as carbon black, coated onto a conductive core. The second, insulative layer comprises a fluoropolymer matrix, which may advantageously contain charge-controlling agents such as dyes, which control the charge-to-mass ratio (q/m) such that the toner charge may be varied independently from the resistance of the coated particles (i.e., in a positive (+) toner, a negative charge controlling agent will lower the toner charge.) Thus, the advantageous properties imparted by the second, insulating layer allow the conductivity of the carrier to be adjusted to a desired value, without disadvantageously degrading the toner charging ability of the carrier. This enables, for example, the use of fairly resistive materials like ferrite as core materials.

A major advantage of the invention is in the ability to use extremely high levels of conductive particles which provide excellent solid area development, without adversely affecting the toner charging ability.

In another aspect of the invention, a unique water-based coating process which offers performance and environmental advantages, is disclosed.

BRIEF DESCRIPTION OF THE SEVERAL VIEWS OF THE DRAWING

These and further features of the invention will be better understood with reference to the accompanying specification and the drawings, in which.

DETAILED DESCRIPTION OF THE INVENTION

Figure 1:
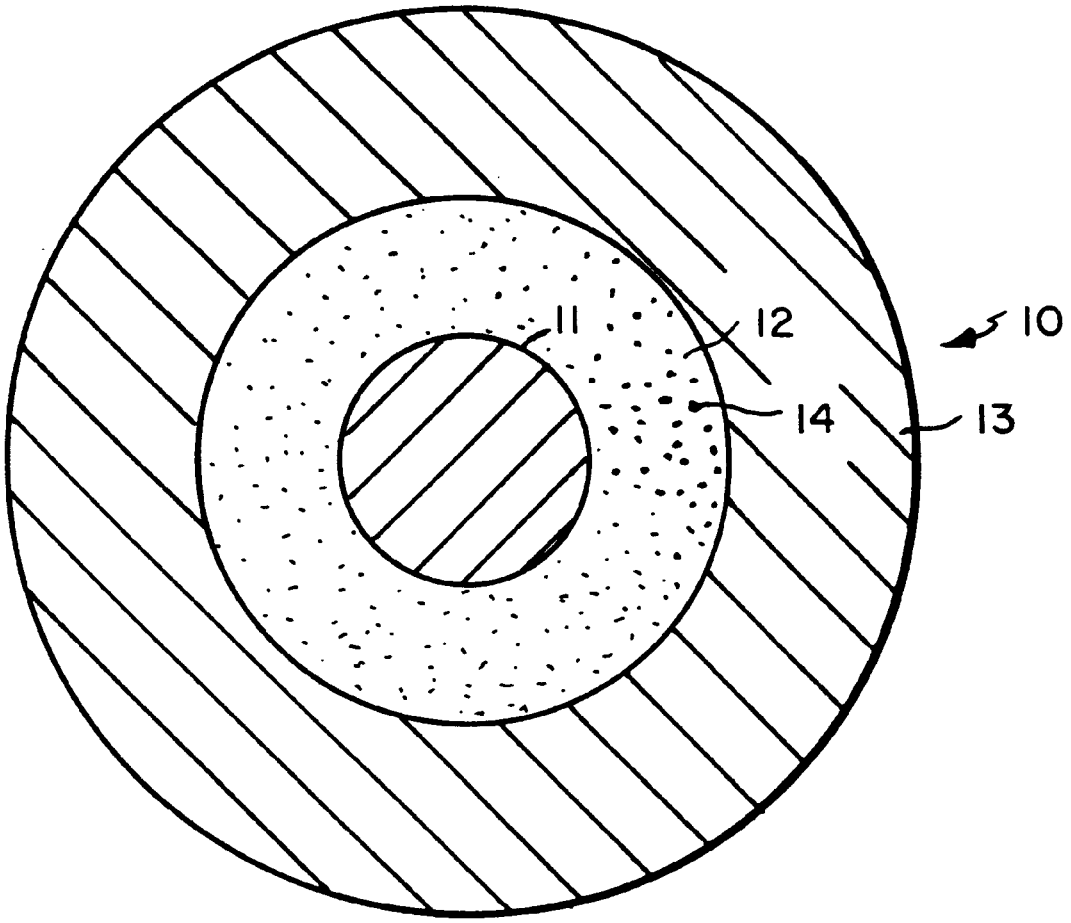
FIG. 1 is illustrative of a carrier particle in accordance with the present invention.

As seen illustratively in FIG. 1, carrier particles 10 of the invention comprise a core 11 and at least two layers, inner layer 12 comprising electroconductive particles 14 and outer layer 13. The physical and electrical properties of the layers differ so as to achieve the desired electrophotographic performance. The core material may be any (preferably) conductive material typically used in the manufacture of carrier particles, such as ferromagnetic materials, steel, nickel, iron, ferrites, passivated iron, or mixtures or alloys thereof. The average particle size (diameter) of the core is typically in the range of 20 to 200 $\mu$m. In an embodiment for use with the advantageous water-based coating processes described herein, the core material is preferably a material which will resist corrosion which might otherwise occur as a result of core particles being exposed to aqueous coating solutions. In this regard, materials such as ferrites or passivated iron are preferred. Depending on the type of development system under consideration, the surface and shape of the core particles may be smooth or irregular.

The first, or inner, coating layer deposited on the core material augments any electroconductive properties of the core itself. As such, it is possible to use less conductive core materials in making the presently disclosed carrier particles. Furthermore, the presence of conductive material in the inner (conductive) layer also enables one to more precisely tailor the electroconductive properties of the carrier particles. The first coating is most desirably obtained by including electroconductive particles dispersed within a fluoropolymer matrix. Electroconductive particles that are well known in the art, such as finely divided carbon black, furnace black, acetylene black and channel black, can be used. Other materials, like inorganic materials including metal borides, carbides, nitrides, oxides and silicides, which have low volume resistivities but may act as development electrodes, may also be used, alone or in combination with the other electroconductive particles disclosed herein. Electroconductive particle size (diameter) is typically 1 $\mu$m or less, preferably 0.5 $\mu$m or less.

In embodiments which use electroconductive particles, a fluoropolymer material is desirably employed to bind the electroconductive particles and adhere itself to the core material as a first or inner coating. Fluoropolymers are preferred for providing the necessary durability and triboelectric properties, although any other suitable resin materials may be used, such as chlorotrifluoroethylene, polyvinylidene fluoride, polytrifluoroethylene and polytetrafluoroethylene; copolymers of vinylidene fluoride and hexafluoropropylene, copolymers of vinylidene fluoride and tetrafluoroethylene; polycarbonates; cellulose acetate butyrate; substituted or unsubstituted polyvinylpyrrolidones; glass; polysulfones; acrylonitrile-butadiene-styrene terpolymer (ABS); polyesters; phenolic resins; nylons; alkylcelluloses; polymethylmethacrylate (PMMA); polystyrenes; polyisobutylenes; natural rubbers; polyformaldehydes; polyamide; polyurethanes; styrene-acrylonitrile copolymers; styrene-butadiene copolymers; or mixtures or combinations or copolymers thereof. The amount of coating in each layer will depend on the particular application, i.e., the resistance and/or conductivity desired, but can be adapted to core materials having widely varying surface areas and shapes. Generally, 0.5–2.0 wt %, based on the core weight, will hold sufficient conductive material for many applications, while 1.5–2.0 wt % has been found to provide a sufficient resistivity ($1–5\times10^9$ ohms © 10–500V) for copying systems such as RICOH copiers. Generally the coating(s) are continuous and/or uniform, but good results may be also obtained employing a discontinuous and/or non-uniform coating.

The second, (outer) coating layer is deposited over the first coating and serves as an insulator for the conductive core material/inner layer combination. The outer, insulative layer triboelectrically charges the toner particles during the electrophotographic process, and shields the conductive inner portion of the carrier from contact with toner particles or other carrier particles. The presence of the outer layer therefore allows for maximizing the properties of the carrier as a development electrode while ensuring that the toner charging properties are not adversely impacted. In a preferred embodiment, the outer insulative layer is made of the same matrix material as the inner layer. More specifically, in a preferred embodiment, both layers are formed predominantly of a fluoropolymer matrix material. The outer layer, however, may desirably further include charge-controlling agents, for controlling the charge to mass ratio (q/m) of toners. For example, the q/m of positive (+) toners may be lowered by incorporation of a negative (−) charge controlling agent, or may be increased by incorporation of a positive (+) charge controlling agent, such as disclosed in U.S. Pat. No. 5,627,001. A surprising and advantageous result of this formulation is that the q/m may be varied independently from the resistance of the carrier particles.

Charge-controlling agents known in the art which may be used in the formulation of the outer layer include Nigrosine dyes; triamino triphenylmethanes; cationic dyes; alkyl pyridinium halides such as cetyl pyridinium halide; organic sulfate or sulfonates; quaternary ammonium halides, methyl sulfates; distearyl dimethyl ammonium sulfate; bisulfates; and dioxazines. Negative charge agents that may be used include heliogen green pigment; metal complexes of phthalic acid, naphthoic acid, or salicylic acid; copper-phthalocyanines; perylenes; quinacidones; o-fluorobenzoic acids; p-halo phenyl carboxylic acids; azo pigments; metal-salt azo pigments; azochromium complexes; chromate (1-) bis{3-hydroxy-4-[(2-hydroxy-3,5-dinitrophenyl) azo]-N-phenyl-2-naphthalene carboxamato(2-)}-hydrogen ("TRH") or salts thereof; and the like. The amount of charge controlling agent to be added to the outer layer will depend on the particular purpose for which the carrier particles are intended, and is readily determinable by those of ordinary skill in the art. However, it has been found that, e.g., 0.5–6.0 wt %, based on the total coating weight, is suitable in practice when employed with positive toners.

The carrier particles may be prepared using conventional methods such as solvent coating or dry coating followed by heat treatment to melt the coating onto the core particles. However, in another aspect of the invention, a unique water-based coating process has been found to offer certain performance and environmental advantages. It has been found that good results are surprisingly obtained using this process, despite the immiscibility of the preferred coating matrix material (i.e., fluoropolymers), in the aqueous carrier. Charge control dyes, if used in the "outer" layer, must be finely and uniformly dispersed so as to charge toner particles to the same degree, regardless of toner orientation on the carrier surface. Dry blending and thermal fusing methods alone do not allow dyes to be finely and uniformly dispersed. Incorporation of conductive carbon or other electroconductive particles by prior art dry-blending processes is also problematic, since no "grinding" or dispersing media can be used to reduce the size of the carbon agglomerates or to fix them uniformly throughout the coating, since no adhesion occurs until the coating polymer actually melts. At this point, no further dispersion can be done without greatly lowering the electrical resistance of the coating. Thus, prior art dry-blending coating methods do not allow the use of efficient dispersing equipment such as fluid energy mills, SWECO mills, ball mills with alumina and ceramic media and the like to control pigment and dye dispersion.

An embodiment of the present invention, employing water as the dispersing and coating vehicle, coupled with a water-soluble temporary binder, allows full control of the dispersion of both electroconductive particles, and charge-control dyes using conventional dispersing apparatus, as well as allowing the controlled and uniform application of such coatings by ordinary methods and equipment such as Würster-column fluidized bed sprayers, modified vacuum drier coaters and the like.

The use of water to disperse coating pigments, dyes and finely powdered fluoropolymers produces no toxic emissions during coating, unlike conventional coatings cast from organic solvents. Storage and disposal problems common with organic solvents are eliminated, and other costs associated with organic solvents are also done away with, as well as environmental monitoring, permitting, etc.

Specific coating methods which have been successfully employed are set forth in the Examples appearing below, along with the general contours of the carrier particle formation process set forth as follows. An aqueous suspension of fluoropolymer may be prepared by dispersing the fluoropolymer in aqueous solution with the aid of a water-soluble "temporary" binder which is subsequently destroyed by heating during fusing of the coating onto the particle. The water soluble temporary binder further provides a means for dispersing electroconductive particles throughout the suspension, and has been found to aid in adhesion of the fluoropolymer binder to the carrier particle. The water soluble temporary binder is particularly useful in preparing the inner layer. Although it is generally unnecessary for the dispersion of fluoropolymer, the binder greatly assists in ensuring coating adhesion to the surface of the core material, and providing abrasion resistance during fluidized bed operation. The water soluble temporary binder is typically a cellulose-based material such as alkyl cellulose, i.e., hydroxypropylmethylcellulose, methylcellulose, and the like. The water based processes disclosed herein are also advantageous from an environmental standpoint, as the use of organic solvents typically used in the art, along with their attendant handling problems, are rendered unnecessary.

After the coating has been applied, the coating may be fixed by conventional thermal fusing, e.g., in a rotary kiln or tube furnace. During this process the water-soluble temporary binder is oxidized and eliminated from the surface of the carrier particle and the fluoropolymer or other suitable resin is melted. A surprising advantage of the use of cellulose esters in particular is that coating may be done with very little shrinkage.

The benefits of the product and processes disclosed herein are further demonstrated in non-limiting fashion in the following Examples.

EXAMPLE 1

Electrophotographic carrier and developer in accordance with the disclosure was prepared as follows. An aqueous latex suspension of KYNAR 460 polyvinylidene fluoride ("PVDF", designated "Kynar 32 Latex" from Elf Atochem), to which was added hydroxypropyl methyl cellulose ("HPMC") in the ratio of 7 parts HPMC for every 100 parts of Kynar 32 to enable the PVDF to properly adhere to the ferrite core particles, was used. A lab attritor with ⅛' stainless steel balls and a ceramic ball mill with ½" centered alumina media were used to disperse XC-72R carbon (Cabot) and T-77 negative (−) charge control dye (Hodogaya) into Kynar 32 latex in the ratio of 85 parts Kynar 32 (dry solids), 10 parts XC-72R carbon and 5 parts of T-77 dye.

An additional 10% solids solution of HPMC in water was added to the above dispersion in the quantity of 7 parts of the dry HPMC for every 100 parts of coating solids. All of the above materials were milled for 18 hours in a ceramic ball mill jar. The solids content was adjusted to 18% with water and the coating was applied to 80 $\mu$m copper-zinc Ferrite (D. M. Steward) substrate using a "Würster-column" fluidized bed coater.

The Kynar was affixed permanently to the core by fusion at an elevated temperature. The coated material was heated at 500° F. for 15 minutes, after which the coating was effectively fused to the core and essentially free of HPMC. The coated particles were sieved through a 100 mesh U.S. STD. sieve to produce a free-flowing powder. The resistance of the coated particles was measured using a rotating magnetic brush electrode assembly and a Hewlett-Packard 4329A high resistance meter.

A second, insulative outer layer comprising Kynar 32 Latex and T-77 dye in the ratio of 95 parts of dry Kynar to 5 parts of Dry T-77 was prepared. This layer was coated in 0.5% wt. carrier increments as follows. After the coating was well mixed with the coated carrier and dried to remove water, the material was spread into a layer of ⅛–¼" thickness in an aluminum tray and fused at 320° F. for 10 minutes, to melt the Kynar. This material was cooled, sieved to <100 mesh as above, and the resistance was measured also as above. This process was repeated two more times. Resistance data are shown in Table 1. The data demonstrate the insulative effect of the outer layer, and the effect of increasing outer layer thickness.

TABLE 1

| | 10 V | 100 V | 1000 V |
|---|---|---|---|
| Inner layer | $1.2 \times 10^6\Omega$ | off | off |
| Outer layer (first coating) | $7.5 \times 10^7\Omega$ | $1.6 \times 10^7$ | off |
| Outer layer (second coating) | $8.5 \times 10^8\Omega$ | $4.7 \times 10^8$ | $1.2 \times 10^6\Omega$ |
| Outer layer (third coating) | $1.65 \times 10^9\Omega$ | $1.9 \times 10^9\Omega$ | $6.0 \times 10^8\Omega$ |

Another carrier material (Carrier 2) having the same inner layer, but a different outer layer composition (97.5% Kynar 32, 2.5% T-77) was prepared in the same manner as described above, except that the inner layer was fused at 485° for 15 minutes.

In both examples, the second layer was compounded by adding the T-77 dye directly to the Kynar 32 latex suspension as received (18.57% total solids in water) and ball milled for 18 hours until the dye was finely divided.

Table 2 displays the resistance data for Carrier 2.

TABLE 2

| | 10 V | 100 V | 1000 V |
|---|---|---|---|
| Inner layer | $1.0 \times 10^7\Omega$ | off | off |
| Outer layer (first coating) | $6.0 \times 10^8\Omega$ | $3.2 \times 10^8\Omega$ | $5.4 \times 10^7\Omega$ |
| Outer layer (second coating) | $1.9 \times 10^9\Omega$ | $4.7 \times 10^8\Omega$ | $9.5 \times 10^8\Omega$ |
| Outer layer (third coating) | $2.0 \times 10^9\Omega$ | $4.5 \times 10^9\Omega$ | $3.0 \times 10^9\Omega$ |

EXAMPLE 2

Developers were made with Carriers 1 and 2, by blending 3% of RICOH 510 Toner manufactured by Nashua Corporation (Nashua, N.H.), with 97% carrier to make 1000 grams of developer for testing in a Ricoh 510 copy machine. Developers were blended for 45 min. on a lab jar roller running at 130 RPM.

Charge-To-Mass ratios (q/m) of these developers were measured and found to be 13.3 μcoulombs/g and 19.2 μcoulombs/g for the developers made with Carriers 1 and 2, respectively.

Lab charge curves were run on 50 g samples of developer, with q/m (μcoulombs/g) measurements made at 2 min., 30 min. and 2 hrs. of mix time. The results are shown in Table 3, below. These curves show that the charge against toner may be varied by adjustment of the quantity of charge-control dye (T-77).

TABLE 3

| | q/m | | |
|---|---|---|---|
| | 2 min. | 30 min | 2 hrs |
| Developer 1 (including carrier 1) | 9.4 | 12.4 | 13.1 |
| Developer 2 (including carrier 2) | 13.3 | 19.3 | 20. |
| Control (Ricoh 510 carrier) | 16.3 | 20.2 | 20.3 |

EXAMPLE 3

Another two layer carrier in accordance with the disclosure, designated Carrier 3, was prepared using an insoluble dry powdered form of PVDF (KYNAR 301F, Elf Atochem). The inner layer consisted of 77.5 parts Kynar 301F in the form of 2–2.5 μm diameter particles and 22.5 parts CONDUCTEX 975 conductive carbon (Columbian), to which an additional seven parts of methyl cellulose 5% solution in water was added as a water-soluble binder/dispersing aid. TRITON X-100, a non-ionic surfactant, was also included as a wetting agent. Sufficient water to make 16% total solids was added and the resulting dispersion was placed in a ceramic ball mill jar with ½" sintered alumina grinding media and dispersed by rolling on a jar roller with 2" diameter rolls turning at 130 RPM for 20 hours.

The outer layer was similarly prepared, consisting of 95 parts Kynar 301F, 5 parts T-77 dye, and 7 parts of methyl cellulose 5% solution in water. Water was added to make 16% total solids and the mixture was milled as the inner layer.

Sufficient coating was prepared to give 0.8 wt % core material for the inner layer and 1.5 wt % core for the outer layer.

Both coating layers were applied to a ferrite core of about 80 μm mean diameter using a Lakso fluidized bed employing a Würster-column. Coatings were applied continuously, switching feed tanks. Since this coater operates by continuously applying an atomized mist of coating droplets followed by immediate drying the second (outer) layer may be applied immediately after the first, resulting in the formation of discrete layers. Therefore, each layer may be formulated in its own manner according to the desired charge and development characteristics.

After coating, the above carrier material was fused by passage through a tube furnace turning at 6 RPM at a temperature of 245° C. and a feed rate of about 500 g/hr. The resulting aggregates were coiled and crushed to separate and sieved through a 100 mesh as above to give a free flowing carrier. The coated resistance, as measured according to Examples 1 and 2, was as follows:

TABLE 4

| 10 V | 100 V | 1000 V |
|---|---|---|
| $1.35 \times 10^9\Omega$ | $4.0 \times 10^9\Omega$ | $1.25 \times 10^9\Omega$ |

Developer was prepared by blending with 3% RICOH 510 type toner made by Nashua Corporation, to make 1000 g of developer for testing in a Ricoh 510 photocopier. The carrier produced more than 80,000 copies without any appreciable filming or wear out.

Laboratory q/m measurements were also determined (as above) and appear in Table 5.

TABLE 5

| 2 min | 30 min | 2 hours |
|---|---|---|
| 15.19 | 21.3 | 24.5 |

Figure 2:
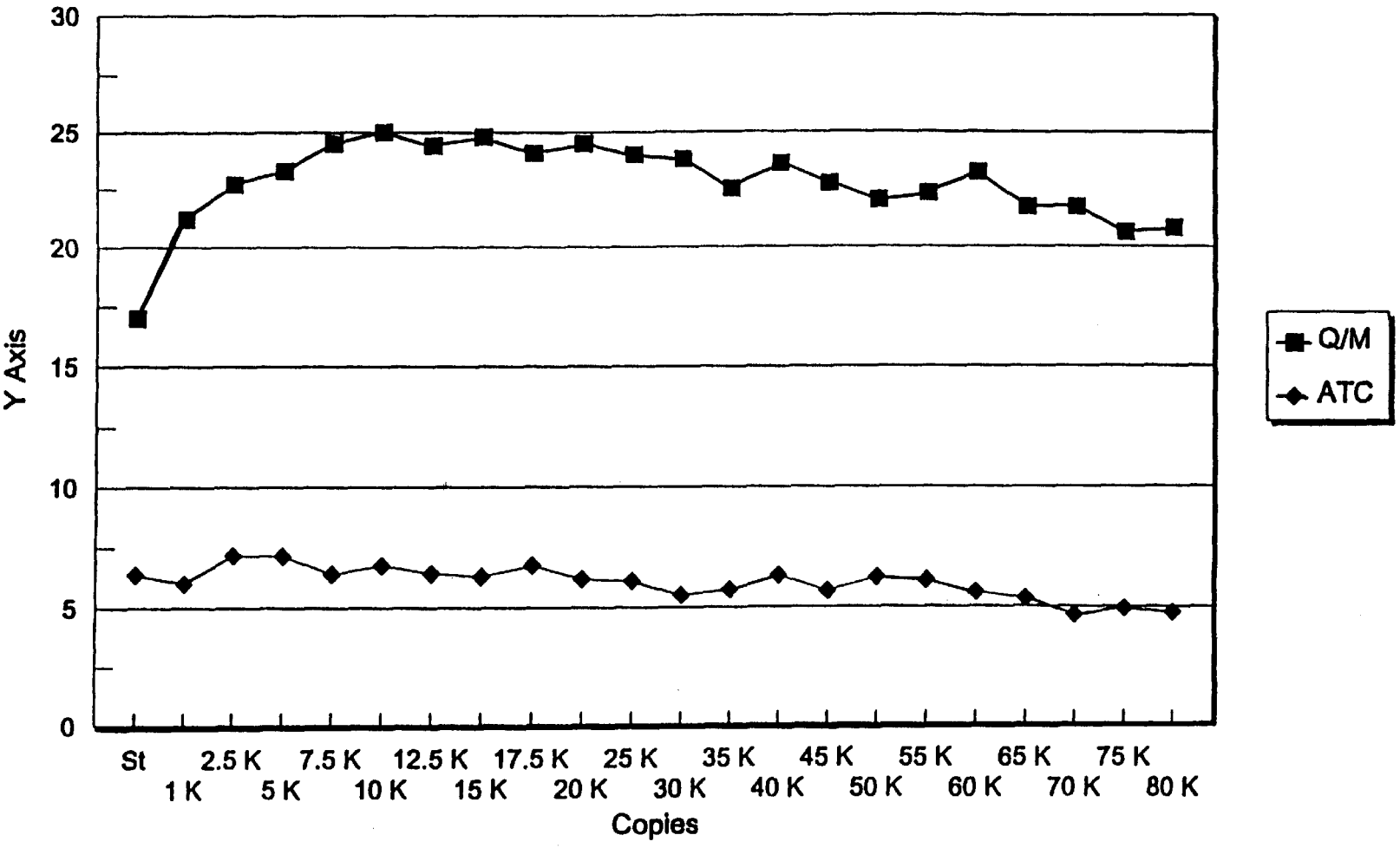
FIG. 2 depicts graphically the charge-to-mass ratio (q/m) and the Apparent Toner Concentration (ATC), for a developer in accordance with the invention.

The q/m and the Apparent Toner Concentration (ATC), the latter a measurement of the carrier's ability to charge and carry toner, was determined over a period of 80,000 copies on the Ricoh 510 machine. The results are presented graphically in FIG. 2, showing the steady ATC levels, the rapid initial rise, and steady maintenance of charge level. This graph illustrates how well carrier in accordance herewith works over an estimated developer lifetime.

The foregoing description is meant to be illustrative of novel carrier compositions, electrophotographic developers containing the same, and methods of making improved carriers and developers. Other embodiments and variations will be apparent to those of ordinary skill in the art without departing from the inventive concepts contained herein. In this regard, the use of "inner" and "outer" in this disclosure in reference to the layers described herein is intended to refer to the relative relationships of the core, first (inner) and second (outer) layers, not to limit the carrier material to a three component article. Accordingly, this invention is to be viewed as embracing each and every novel feature and novel combination of features present in or possessed by the invention disclosed herein and is to be viewed as limited solely by the scope and spirit of the appended claims.

I claim:

1. An electrophotographic carrier particle comprising:

a. carrier core material;

b. a first coating layer generally surrounding said carrier core material containing electroconductive particles dispersed therein; and c. a second, insulative coating layer generally surrounding said first coating layer.

2. The carrier of claim 1 wherein said carrier core material is selected from the group consisting of ferrite and passivated iron.

3. The carrier of claim 1 wherein said second coating comprises charge-controlling or charge-modifying compounds.

4. The carrier of claim 3 wherein said charge-controlling or charge-modifying compound is a positive charge-controlling or charge-modifying compound selected from the group consisting of Nigrosine dyes; triamino triphenylmethanes; cationic dyes; alkyl pyridinium halides; organic sulfate or sulfonates; quaternary ammonium halides, methyl sulfates; distearyl dimethyl ammonium sulfate; bisulfates; and dioxazines.

5. The carrier of claim 3 wherein said charge-controlling or charge-modifying compound is a negative charge-controlling or charge-modifying compound selected from the group consisting of heliogen green pigment; metal complexes of phthalic acid, naphthoic acid, or salicylic acid; copper-phthalocyanines; perylenes; quinacidones; o-fluorobenzoic acids; p-halo phenyl carboxylic acids; azo pigments; metal-salt azo pigments; azochromium complexes; chromate (1-) bis{3-hydroxy-4-[(2-hydroxy-3,5-dinitrophenyl) azo]-N-phenyl-2-naphthalene carboxamato (2-)}-hydrogen ("TRH") or salts thereof.

6. The carrier of claim 1 wherein said first coating layer is on said carrier core material.

7. The carrier of claim 1 wherein said first and second coating layers comprise a fluoropolymer.

8. The carrier of claim 1 wherein said fluoropolymer in said first and second coating layers is the same composition.

9. The carrier of claim 1 wherein said carrier core material is conductive.

10. The carrier of claim 1 wherein said carrier core material is particles having an average particle size (diameter) in the range of 20 to 200 $\mu$m.

11. The carrier of claim 1 wherein said electroconductive particles are selected from the group consisting of carbon black, furnace black, acetylene black, channel black, metal borides, carbides, nitrides, oxides, and silicides; and mixtures thereof.

12. The carrier of claim 1 wherein said carrier core material is selected from the group consisting of ferromagnetic materials, steel, nickel, iron, ferrites, passivated iron; or mixtures or alloys thereof.

13. The carrier of claim 1 wherein said inner or outer coating is selected from the group consisting of chlorotrifluoroethylene, polyvinylidene fluoride, polytrifluoroethylene and polytetrafluoroethylene; copolymers of vinylidene fluoride and hexafluoropropylene, copolymers of vinylidene fluoride and tetrafluoroethylene; polycarbonates; cellulose acetate butyrate; substituted or unsubstituted polyvinylpyrrolidones; glass; polysulfones; acrylonitrile-butadiene-styrene terpolymer (ABS); polyesters; phenolic resins; nylons; alkylcelluloses; polymethylmethacrylate (PMMA); polystyrenes; polyisobutylenes; natural rubbers; polyformaldehydes; polyamide; polyurethanes; styrene-acrylonitrile copolymers; styrene-butadiene copolymers; mixtures or combinations or copolymers thereof.

14. A process of making an electrophotographic carrier material, comprising the steps of:

a. providing carrier core material;

b. in a first coating step coating said carrier core material with a first coating layer composition comprising an aqueous dispersion of fluoropolymer, electroconductive particles, and water-soluble temporary binder composition, so as to obtain a first-coated carrier core material;

c. in a second coating step coating said first-coated carrier core material with an aqueous suspension of said fluoropolymer so as to obtain a second coated carrier core material.

15. The process of claim 14 further comprising a drying step between said first and second coating steps.

16. The process of claim 14 wherein said water-soluble temporary binder composition is an alkyl cellulose selected from the group consisting of methyl cellulose.

17. The process of claim 14 wherein said carrier core material is selected from the group consisting of ferrite and passivated iron.

18. The process of claim 14 wherein said second coating comprises charge-controlling or charge-modifying compounds.

19. The process of claim 14 further comprising a drying step after said second coating step.

20. The process of claim 14 wherein said dispersion is a latex.

21. The process of claim 14 wherein said core material is conductive.

22. The process of claim 14 wherein said core material is particles having an average particle size (diameter) in the range of 20 to 200 $\mu$m.

23. An electrophotographic developer comprising toner, and carrier comprising:

a. carrier core particles;

b. a first coating layer generally surrounding said carrier core particles containing electroconductive particles dispersed therein; and c. a second, insulative coating layer generally surrounding said first coating layer.

24. The developer of claim 23 wherein said carrier core material is selected from the group consisting of ferrite and passivated iron.

25. The developer of claim 23 wherein said second coating comprises charge-controlling or charge-modifying compounds.

26. The developer of claim 25 wherein said charge-controlling or charge-modifying compound is a positive charge-controlling or charge-modifying compound selected from the group consisting of Nigrosine dyes; triamino triphenylmethanes; cationic dyes; alkyl pyridinium halides; organic sulfate or sulfonates; quaternary ammonium halides, methyl sulfates; distearyl dimethyl ammonium sulfate; bisulfates; and dioxazines.

27. The developer of claim 25 wherein said charge-controlling or charge-modifying compound is a negative charge-controlling or charge-modifying compound selected from the group consisting of heliogen green pigment; metal complexes of phthalic acid, naphthoic acid, or salicylic acid; copper-phthalocyanines; perylenes; guinacidones; o-fluorobenzoic acids; p-halo phenyl carboxylic acids; azo pigments; metal-salt azo pigments; azochromium complexes; chromate (1-) bis{3-hydroxy-4-[(2-hydroxy-3,5-dinitrophenyl) azo]-N-phenyl-2-naphthalene carboxamato (2-)}-hydrogen ("TRH") or salts thereof.

28. The carrier of claim 23 wherein said first coating layer is on said carrier core material.

29. The developer of claim 23 wherein said first and second coating layers comprise a fluoropolymer.

30. The developer of claim 23 wherein said fluoropolymer in said first and second coating layers is the same composition.

31. The developer of claim 23 wherein said carrier core material is conductive.

32. The developer of claim 23 wherein said carrier core material is particles having an average particle size (diameter) in the range of 20 to 200 $\mu$m.

33. The developer of claim 23 wherein said electroconductive particles are selected from the group consisting of carbon black, furnace black, acetylene black, channel black, metal borides, carbides, nitrides, oxides, and silicides; and mixtures thereof.

34. The developer of claim 23 wherein said carrier core material is selected from the group consisting of ferromagnetic materials, steel, nickel, iron, ferrites, passivated iron; or mixtures or alloys thereof.

35. The developer of claim 23 wherein said inner or outer coating is selected from the group consisting of chlorotrifluoroethylene, polyvinylidene fluoride, polytrifluoroethylene and polytetrafluoroethylene; copolymers of vinylidene fluoride and hexafluoropropylene, copolymers of vinylidene fluoride and tetrafluoroethylene; polycarbonates; cellulose acetate butyrate; substituted or unsubstituted polyvinylpyrrolidones; glass; polysulfones; acrylonitrile-butadiene-styrene terpolymer (ABS); polyesters; phenolic resins; nylons; alkylcelluloses; polymethylmethacrylate (PMMA); polystyrenes; polyisobutylenes; natural rubbers; polyformaldehydes; polyamide; polyurethanes; styrene-acrylonitrile copolymers; styrene-butadiene copolymers; mixtures or combinations or copolymers thereof.

* * * * *